United States Patent [19]

Eiermann

[11] Patent Number: 4,797,076

[45] Date of Patent: Jan. 10, 1989

[54] INNER SEAL OF A ROTARY PISTON ENGINE

[75] Inventor: Dankwart Eiermann, Weissenberg, Fed. Rep. of Germany

[73] Assignee: Wankel GmbH, Berlin, Fed. Rep. of Germany

[21] Appl. No.: 872,592

[22] Filed: Jun. 10, 1986

[51] Int. Cl.[4] ..... F01C 19/00; F04C 27/00; F16J 15/34

[52] U.S. Cl. ..... 418/142; 277/81 P; 277/95; 277/175; 277/181

[58] Field of Search ..... 277/81 P, 95, 53, 152, 277/236, 192, 214, 175, 181; 418/142; 415/174

[56] References Cited

U.S. PATENT DOCUMENTS

| | | | |
|---|---|---|---|
| 1,930,708 | 10/1933 | Cunningham | 277/95 X |
| 3,275,331 | 9/1966 | Mastrobattista et al. | 277/35 X |
| 3,410,255 | 11/1968 | Winkelmann et al. | 418/117 X |
| 3,827,701 | 8/1974 | Sakamaki | 277/81 P |
| 3,941,525 | 3/1976 | Wilmers et al. | 418/142 |
| 4,052,310 | 10/1977 | Nolan | 277/95 X |
| 4,058,321 | 11/1977 | Gauran et al. | 418/142 X |
| 4,080,120 | 3/1978 | Eiermann | 418/142 |
| 4,202,554 | 5/1980 | Snell | 277/53 |
| 4,415,317 | 11/1983 | Butterworth | 418/142 X |
| 4,526,509 | 7/1985 | Gay, Jr. et al. | 277/53 X |

FOREIGN PATENT DOCUMENTS

| | | | |
|---|---|---|---|
| 1216042 | 11/1966 | Fed. Rep. of Germany . | |
| 2202899 | 5/1980 | Fed. Rep. of Germany . | |
| 2550889 | 5/1985 | Fed. Rep. of Germany . | |
| 3607 | 1/1979 | Japan | 418/142 |

*Primary Examiner*—Allan N. Shoap
*Attorney, Agent, or Firm*—Becker & Becker, Inc.

[57] ABSTRACT

An inner seal of a rotary piston engine has a U-shaped base body with legs running along the adjoining housing sidewall. During movement of the piston, the oil adhering along the housing sidewall is conveyed in an opening in the housing sidewall concentric to an eccentric shaft. The inner seal has a plurality of sealing laminations that are arranged along an inner base surface thereof and that are located with a scraper edge forming an acute abutting angle along the housing sidewall counter to direction of rotation. The angle of the scraper edge located in the plane of the housing sidewall equals respectively is smaller than that of the tangent along the rising branch of the trochoidal path, course or runway described by an inner corner of the scraper edge upon the housing sidewall relative to a radius of the inner seal intersecting this corner.

5 Claims, 3 Drawing Sheets

INNER SEAL OF A ROTARY PISTON ENGINE

BACKGROUND OF THE INVENTION

1. Field of the Invention

An inner face seal is arranged in a face or front surface of a piston rotating upon an eccentric of a rotary piston engine. The seal has a base body that is U-shaped in axial cross section thereof. The seal includes arms or legs forming two sealing rings, that include end surfaces which slide along and against the adjoining sidewall and which are effective as sealing surfaces subject to contact pressure exerted via spring action. A bore in this sidewall coaxial to the eccentric shaft is partially polished, buffed or abraided by an inner sealing surface of the seal during rotation of the piston.

2. Description of the Prior Art

Such an inner face seal has a purpose to prevent the passage of fluid cooling medium and lubricating medium from the gearing or power (gear) transmission and piston mounting or bearing chamber into the working or operating chambers. The leakage fluid penetrating into the space or chamber between the two sealing rings is conveyed in a crescent-shaped segment or section of the opening coaxial to the eccentric shaft in the housing sidewall polished, buffed or abraided by the seal.

Such an inner seal and especially the manner of operation or effectiveness of such a seal can be found described in German Pat. No. 12 16 042—Bentele et al issued Nov. 24, 1966 corresponding to U.S. Pat. No. 3,171,590—Bentele et al dated Mar. 2, 1965. German Pat. Nos. 22 02 899—Eiermann issued May 20, 1980 corresponding to U.S. Pat. No. 3,816,041—Eiermann dated June 11, 1974 and 25 50 889—Eiermann issued May 23, 1986 corresponding to U.S. Pat. No. 4,080,120—Eiermann dated Mar. 21, 1978, both belonging to the assignee of the present invention, describe such inner seals which have transverse webs or crossbars between the legs of the U-shaped foundation or base body forming individual chambers. A return or running-back of the oil is prevented or hindered upon the side of the sealing ring that is not polishing, or buffing or abraiding the bore or opening in the housing sidewall. Sealing rings which run against the sidewalls with the surfaces of the legs and intermediate crosspieces or bars are described by these German Patents. Of course there is guaranteed or assured with the two last-mentioned patents that these surfaces are ground smooth and consequently always engage in a flat planar or surface-to-surface relationship. However there cannot be hindered or prevented that an oil film is maintained under these butting faces and in this manner residue or remainder of oil still can enter into the working or operating chambers. The requirements consequently cannot be adequately and sufficiently fulfilled with such seals for attaining cleanliness of the exhaust gases with motors or engines to be free of combustion products of the oil or for the compressed or pressurized air delivered by the compressors to be free of oil.

An object of the present invention is to provide a still further improved oil separation from the housing sidewalls via the present inventive seal.

This object, and other objects and advantages of the present invention, will appear more clearly from the following specification in conjunction with the accompanying drawings.

SUMMARY OF THE INVENTION

The sealing laminations, disks or segments are arranged between the webs or crosspieces of the base body of the sealing ring with scraping edges that wipe or sweep over the housing sidewall. The scraping edges are located extending or projecting against the housing sidewall counter to the direction of rotation as to raceways, paths or runways upon the housing sidewall with trochoidalshaped limits or boundaries and with a width differing as to the housing axes respectively according to positioning of the scraper edges. These paths or runways coincide in an overlapping manner and together give or provide a circular surface cleared by the scraper edges. The circular surface concentrically surrounds the opening in the housing sidewall and extends as far as into the vicinity of the crevasses or dips of the mantle course, path, runway or track. With that, most of all, the regions located in the vicinity of the opening in the housing sidewall are traversed by several scraping edges sequentially during every rotation of the piston. Via the slanted or inclined positioning of the scraping edges, an angle results that is open radially counter to the rotational direction with respect to the radii of the sealing ring. The angle cannot be allowed to be greater than that of the tangent to the rising branch or leg of the trochoidal path described or defined by the inner scraping edge corner in the reversal point thereof; since otherwise the scraper edges would operate radially outwardly, there is attained that all oil residues on the housing inner wall within the noted circular surface are cleared away or removed accordingly and discharged. Consequently no oil film can be traversed anymore by the radial seals of the piston and consequently no oil can come anymore out of the piston bearing or mounting space or chamber and the gearing or power (gear) transmission into the working or operating chambers.

The sealing laminations or disks can be connected by spot welds or rivets with respect to a plate or sheet ring or can be connected among each other in a problemless automatic production method or procedure. The sealing-lamination ring is assembled or mounted via a simple placement or insertion in the base body of the sealing ring.

DESCRIPTION OF A PREFERRED EMBODIMENT

Figure 1:
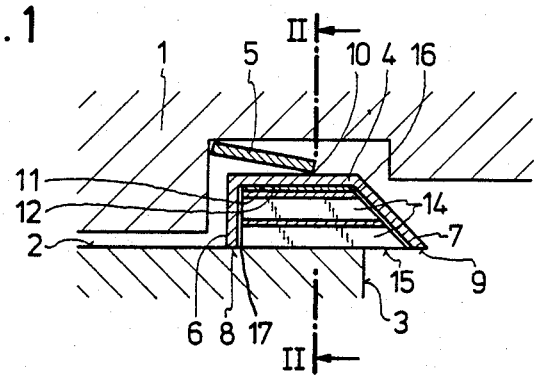
FIG. 1 is a radially-sectioned view through an inner seal according to the present invention taken in a plane along a line I—I in FIG. 2 in an installed condition.

FIG. 1 illustrates a piston 1 of a rotary piston engine or trochoidal type of construction as well as a housing sidewall 2 of this rotary piston engine; the piston 1 and the housing sidewall 2 both are only partially illustrated. An opening 3 in the housing sidewall 2 is concentric to an eccentric shaft. Also shown is a U-shaped base body 4 of the inner seal and a cup spring 5 presses the base body 4 of the inner seal against the adjoining housing sidewall 2. The base body 4 has a radially outer leg 6 with an angle of incidence or setting angle of 90° to the left of the drawing and a radially inner leg 7 with an angle of incidence or setting angle of 60° to the right in the drawing, which traverses or passes over the opening in the housing sidewall 2 in the piston position illustrated in FIG. 1. The oil in this opening 3 is enclosed within the base body 4 and is emptied or discharged under effectiveness of centrifugal force. The legs or arms 6 and 7 of the base body 4 engage with the butting surfaces 8 and 9 against the housing sidewall 2 under effectiveness of a cup spring 5. An edge 10 of the cup spring 5 must engage against the base body 4 in such a manner that the load is distributed uniformly upon the butting surfaces 8 and 9. Other types of springs can be employed in place of the cup spring 5 and the space between the base body 4 and the piston 1 can be sealed-off further by an O-ring.

Figure 2:
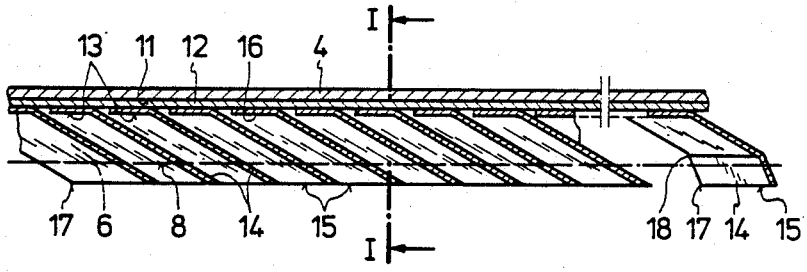
FIG. 2 is a partially longitudinally-sectioned view taken in a plane along line II—II in FIG. 1 through the same inner seal in a removed or disassembled condition.
Figure 3:
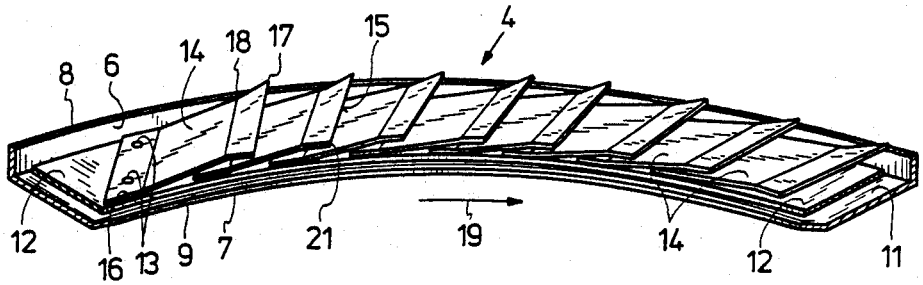
FIG. 3 is a perspective view of a partial section of the inner seal according to the present invention in a removed or disassembled condition.

A round cut-out metal or plate strip 12 is inserted or placed in the base body 4 engaging against a base, basal plane or surface 11 of the strip 12. Also, multiple sealing laminations or sheets 14 are arranged in equal spacing from each other at locations 13 by spot welding or riveting. These sealing laminations or sheets 14 are longer strips of resilient steel plate or sheet metal and are spread away from the fastening point at 13 starting in an angle of approximately 30°, so long as the inner seal is not installed or inserted. The length of the longer strips results since the strips in this position project over the legs or arms 6 and 7 (FIG. 2). The sealing laminations or sheets are placed against each other so tightly that they overlap each other and the spacing of the laminations or sheets among each other results from the space or chamber which is required for a section or segment 16 that engages at the plate strips fastened at 13. This plate strip 12 can be eliminated when the sealing laminations or sheets 14 among each other are fastened at the sections or segments 16. The sealing laminations or sheets 14 at the outer ends have scraping edges 15 which extend slanted or inclined to the respectively intersecting radii of the inner seal and moreover in the front with the radially outer corner 17 in the rotational direction of the piston. The scraper edges 15 with an installed inner seal engage or lie against the adjoining housing sidewall 2 under the pressure of the springiness or spring action of their own, which however is not so large or great that this would bring about or lead to a lifting of the butting surfaces 8 and 9 of the legs or arms 6 and 7. In order to keep the scraper edges 15 sharp and most of all to avoid the polishing or abraiding of the butting surface 9 that is wide because of the acute angularity of the angle of incidence or setting angle of the scraper edge 15, it is expedient that the sealing laminations or sheets 14 are cut out of a thin-wall plate or sheet. A desired more steep angle of incidence or setting angle can be provided by bending-in of the sealing laminations or sheets at 18 parallel to the scraper edge 15.

Figure 4:
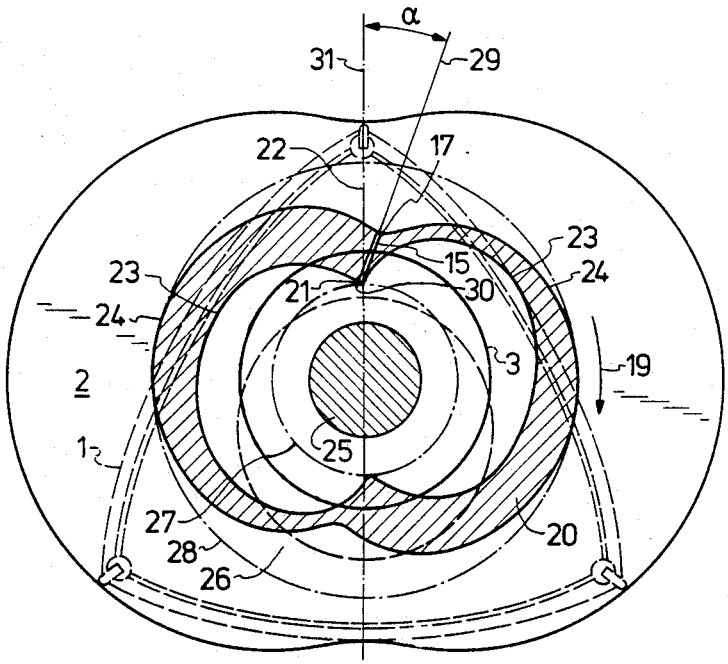
FIG. 4 is a plan view upon a housing sidewall against which the inner seal engages or runs according to the present invention.

The angle of inclination or slanting of the scraper edges 15 in the plane of the housing sidewall 2 relative to the radial direction is apparent from FIG. 4: FIG. 4 shows the housing sidewall 2 and the trochoidal surface 20 of a scraper edge 15 which has traversed thereon in the direction of the arrow 19; in the illustrated position of the piston 1 represented by dash lines, the scraper edge 15 engages in a lower dead center position with a radially inner corner 21 against a long axis 22 of the piston 1. The trochoidal surface 20 is defined or limited by the two trochoids 23 and 24. The other scraper edges, following the illustrated scraper edge 15, stroke or sweep over surfaces congruent or in geometrical conformity if superimposed with respect to the trochoidal surface 20. The surfaces however, according to spacing of the scraper edges 15, shift among each other counter to clockwise direction and overlapping each other. The trochoidal surfaces swept over by all scraper edges 15 uncover or expose a circular ring surface 26 concentric to the eccentric shaft 25 upon the housing sidewall 2, which is localized or bounded by the circles 27 and 28.

Figure 5:
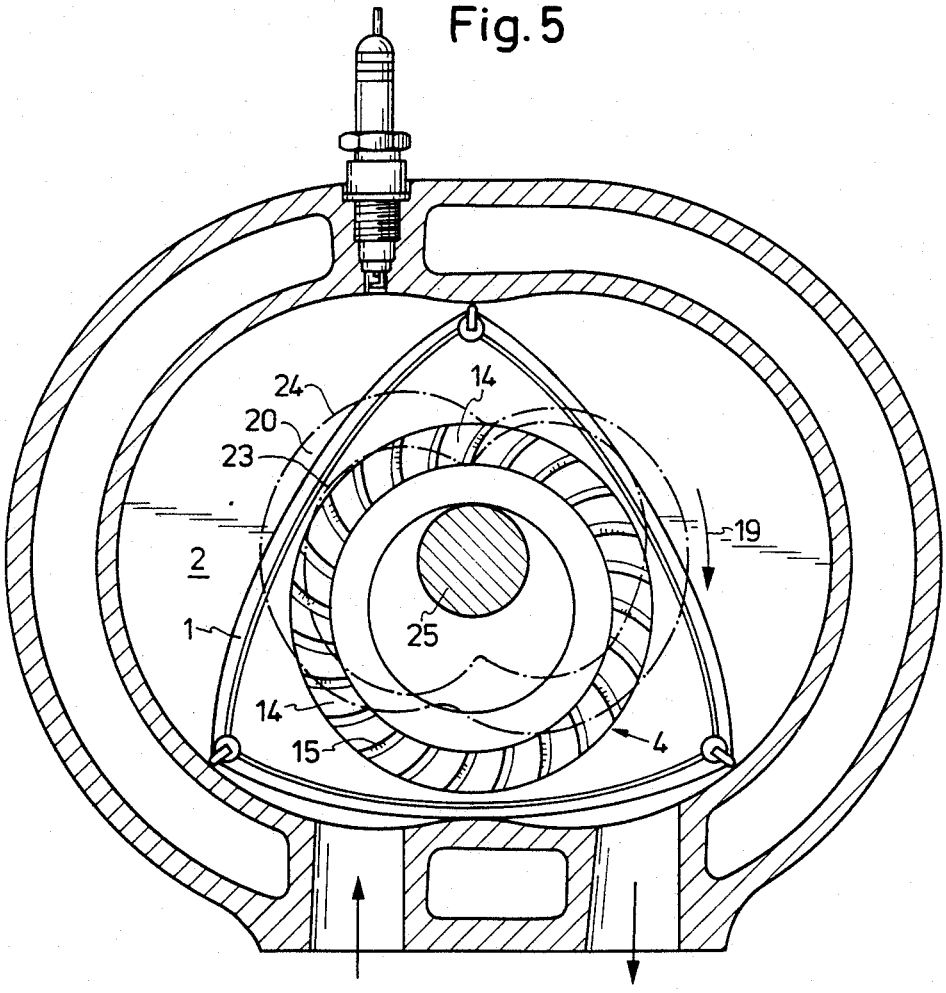
FIG. 5 is a partially sectioned view that shows a location of the seal and opening in a housing sidewall as seen radially in a manner similar to the view of FIG. 4.

FIG. 5 shows a location of the seal in FIG. 4 and also shows the opening 3 as well as other features identified by reference numerals corresponding to those in FIG. 4.

The angle $\alpha$ of the slant or inclination of the scraper edges 15 relative to a radius of the inner seal is determined by the tangent 29 along a rising branch of the radially inner trochoidal path, course or runway 23 at the reversal point or location 30 which is described by the radially inner corner 21 of the scraper edge 15. The angle $\alpha$ of the slant or inclination of the scraper edges 15 is then that which is located between the tangent 29 and a radius 31 of the inner seal extending through the reversal point 30, which here coincides with the long axis 22 of the piston 1.

The slant or inclination angle of the scraper edges 15 can be more acute or pointed than the angle $\alpha$ but this slant or inclination angle cannot be more blunt than this since otherwise the scraper edges 15 would convey the oil outwardly rather than inwardly.

In order to maintain the resilient movability of the sealing laminations or sheets 14 with respect to the slanted or inclined abutting angle of the leg 7 of the base body 4, these sealing laminations or sheets 14 cannot so closely or tightly engage or lie against the inner side of the leg or arm 7 of the U-shaped base body 4, so that chambers form between the arms or legs 6 and 7. As a result of close sequence of the scraper edges 15 however, such large oil quantities or volume can never collect, whereby a seepage of the oil through the gap between the arm or leg 7 and the sealing laminations or sheets 14 can arise in the part of the sealing ring not located over the opening 3. With that however the width of the sealing strip or lamination sheet 14 can be so great that the radially inner corner of the scraper edge 15 during the pressing against the housing sidewall 2 lies directly adjacent to the abutting surface 8 of the leg or arm 7.

The present invention is, of course, in no way restricted to the specific disclosure of the specification and drawings, but also encompasses any modifications within the scope of the appended claims.

What I claim is:

1. An inner face seal, which is arranged axially in an end surface of a rotary piston engine of trochoidal-type construction including an eccentric shaft and a housing with axially opposite housing sidewalls and with an inner periphery having at least one arcuate runway as well as said housing sidewalls having central axial bore openings through which said eccentric shaft passes and journals a multi-corner rotary piston rotating upon said eccentric shaft, said seal having a base body U-shaped in axial cross section including a base surface and legs having a scraper edge at an outward end thereof extending therefrom, which legs form two sealing rings including end surfaces effective as inner sealing surfaces that glide and move along an adjoining housing sidewall under resilient spring-effect pressing engagement of said sealing surfaces, as well as means defining a bore opening in this housing sidewall and located coaxial to the eccentric shaft, said opening being partially polished and wipedover by the inner sealing surfaces during rotation of the piston, the improvement therewith which comprises:

that a plurality of resilient trapezoidally shaped sealing lamination segments in layers tightly placed for overlapping each other in a closely matched relationship with freedom of resilient movability thereof being maintained although secured at the base surface in the U-shaped base body, so that said sealing lamination segments allow said legs to move and engage resiliently for sealing purposes along said housing sidewall so as to be pressed and engaged via the scraper edges thereof leading in a rotational direction and having an acute abutting angle at sealing engagement location of said sealing surfaces, said scraper edges forming an angle $\alpha$ in rotational direction via a radius of the inner face seal to assure that oil residues are cleared away and discharged under effectiveness of centrifugal force along with close sequence of said scraper edges whereby large oil quantities or volume can never collect.

2. An inner face seal according to claim 1, in which the angle of sealing engagement between the scraper edges and said sealing surfaces at most equals the angle $\alpha$ formed by a tangent relative to a radially outwardly rising portion as to a trochoidal-type construction including the arcuate runway described by an inner corner of the scraper edges along the adjoining housing sidewall relative to a reversal point thereof and intersecting this reversal point.

3. An inner face seal according to claim 1, in which said sealing lamination segments overlapping each other each are cut out of an elastic thin steel plate.

4. An inner face seal according to claim 1, in which said sealing lamination segments project from and are fastened to a ring-shaped plate strip inserted in said U-shaped base body.

5. An inner face seal according to claim 1, in which the sealing lamination layer segments are cut out trapezoidally shaped including a root region therewith, said sealing lamination segments in said root region having width of said base surface of the U-shaped base body and the scraper edges having a length of the open width between the sealing surfaces of the legs of said U-shaped base body.

* * * * *

UNITED STATES PATENT AND TRADEMARK OFFICE

CERTIFICATE OF CORRECTION

PATENT NO. : 4,797,076

DATED : Jan. 10, 1989

INVENTOR(S) : Dankwart Eiermann

It is certified that error appears in the above-identified patent and that said Letters Patent is hereby corrected as shown below:

On the title page, please add:
[30] Foreign Application Priority Data

June 10, 1985 [DE] Fed. Rep. of Germany....3520720.5

Signed and Sealed this

Twenty-seventh Day of June, 1989

*Attest:*

DONALD J. QUIGG

*Attesting Officer*

*Commissioner of Patents and Trademarks*